United States Patent [19]

Eckerle et al.

[11] Patent Number: 5,024,611

[45] Date of Patent: Jun. 18, 1991

[54] POSEABLE DOLL MAGNETICALLY SECURED TO ITS STAND

[76] Inventors: Douglas W. Eckerle, 1310 N. Daisy, Escondido, Calif. 92027; Frank P. Sainburg, P.O. Box 11133, Bakersfield, Calif. 93389

[21] Appl. No.: 380,151

[22] Filed: Jul. 14, 1989

[51] Int. Cl.[5] ..... A63H 3/00; A63H 33/26; A63H 3/46; A43B 13/14

[52] U.S. Cl. ..... 446/268; 446/139; 446/378; 446/390; 273/285; 36/112; 36/31; 40/426; 40/600

[58] Field of Search ..... 446/268, 129, 130, 137, 446/138, 139, 285, 294, 317, 323, 370, 371, 373, 374, 375, 376, 378, 379, 390, 487; 273/282 C, 285, 286, 239; 36/112, 103, 31, 7.8; 40/426, 600, 621, 592; 248/206.5, 309.4

[56] References Cited

U.S. PATENT DOCUMENTS

| | | | |
|---|---|---|---|
| 2,336,467 | 12/1943 | Cohen | 446/374 |
| 2,454,095 | 11/1948 | Sandlovich | 248/194 |
| 2,925,683 | 2/1960 | Cohn | 446/378 |
| 3,009,284 | 11/1961 | Ryan | 446/376 |
| 3,124,501 | 3/1964 | Wise | 24/303 X |
| 3,237,345 | 3/1966 | Feliziai | 446/130 |
| 3,276,734 | 10/1966 | Goldblatt | 248/176 |
| 3,279,736 | 10/1966 | Vogt | 248/346 |
| 3,287,847 | 11/1966 | Gardel et al. | 446/390 X |
| 3,310,267 | 3/1967 | Koehler | 248/176 |
| 3,345,030 | 10/1967 | Speers | 248/346 |
| 3,516,632 | 6/1970 | Hall | 248/176 |
| 3,628,282 | 12/1971 | Johnson | 446/378 X |
| 3,699,712 | 10/1972 | Handler et al. | 446/325 |
| 3,745,698 | 7/1973 | Davidson | 446/129 |
| 3,849,930 | 11/1974 | Stubbman | 446/137 |
| 3,862,513 | 1/1975 | Isaacson et al. | 446/386 |
| 4,127,251 | 11/1978 | Sapkus et al. | 248/176 |
| 4,275,887 | 6/1981 | Tateyama | 273/285 X |
| 4,573,457 | 3/1986 | Parks | 36/31 X |
| 4,878,878 | 11/1989 | Bittner | 446/139 |

FOREIGN PATENT DOCUMENTS

| | | | |
|---|---|---|---|
| 2450622 | 11/1980 | France | 446/139 |

*Primary Examiner*—Mickey Yu
*Assistant Examiner*—D. Neal Muir
*Attorney, Agent, or Firm*—Fulwider, Patton, Lee & Utecht

[57] ABSTRACT

A doll support apparatus including a ferromagnetic base having an upwardly facing support surface for receiving the bottom surface of a doll foot device incorporating a magnetic insert which, when supported on such surface, is disposed in close proximity to the ferromagnetic base to thereby maintain the doll in an erect position. The foot device may be in the form of a foot having a magnetic insert embedded directly there into or may be in the form of a removable shoe having the magnetic insert embedded therein. The foot or shoe may incorporate a hinge element which incorporates a releasable lock for locking the shoe or foot in selected different positions.

5 Claims, 2 Drawing Sheets

FIG. 1
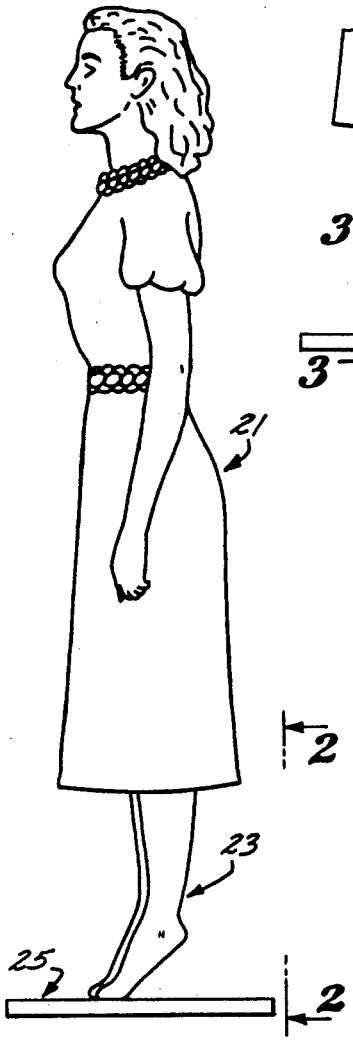
FIG. 2
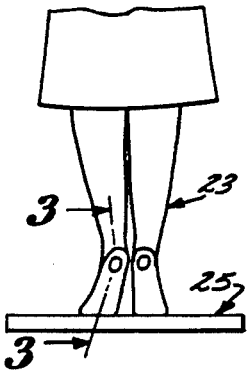
FIG. 3
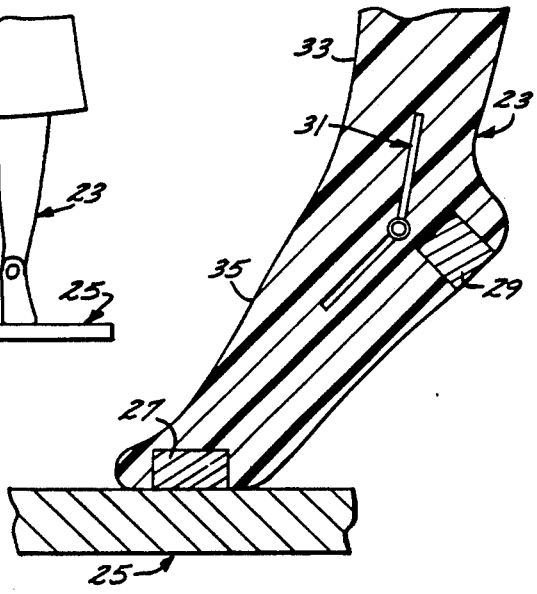
FIG. 4
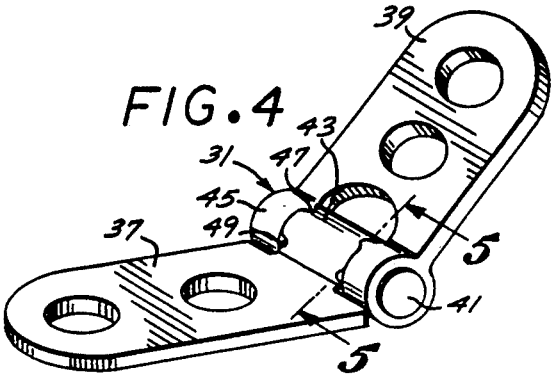
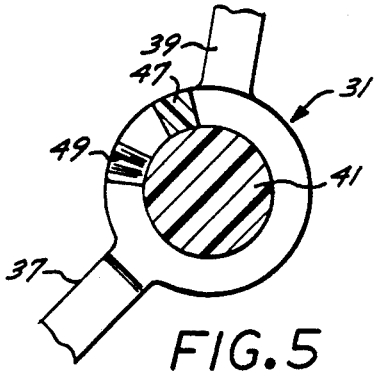
FIG. 5
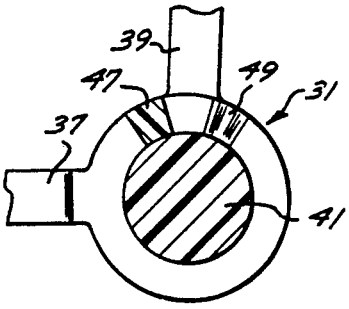
FIG. 6

FIG. 7
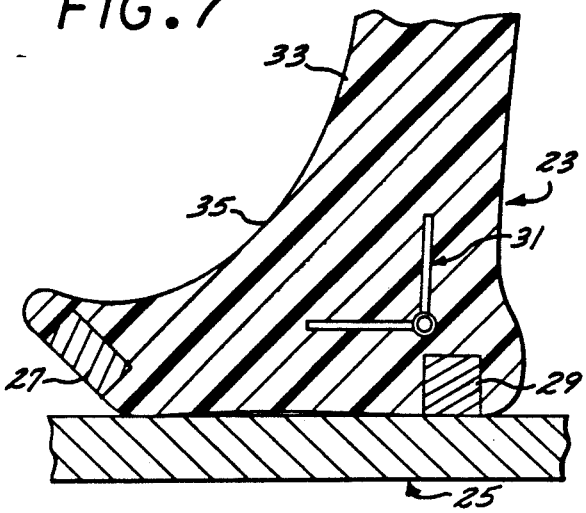
FIG. 8
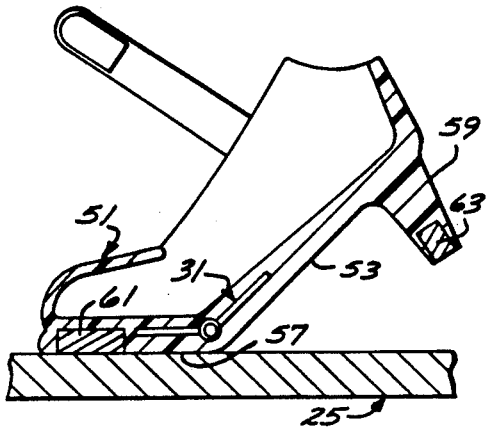
FIG. 9
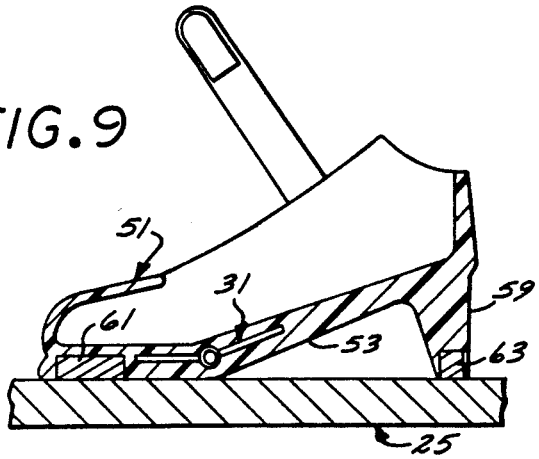
FIG. 10
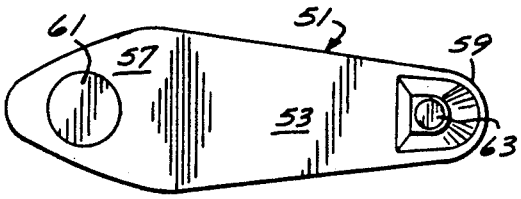
FIG. 11
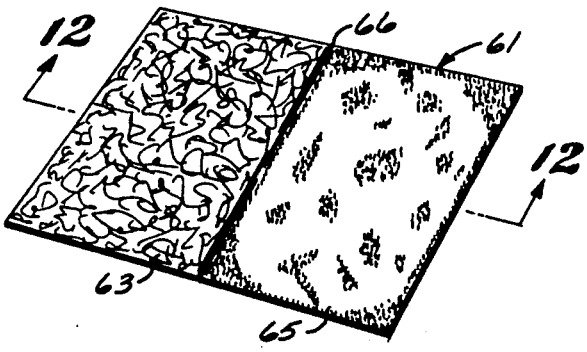
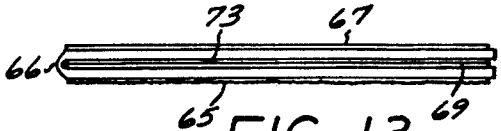
FIG. 13
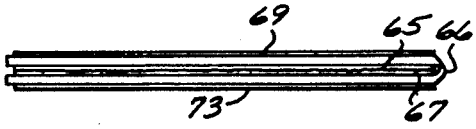
FIG. 14
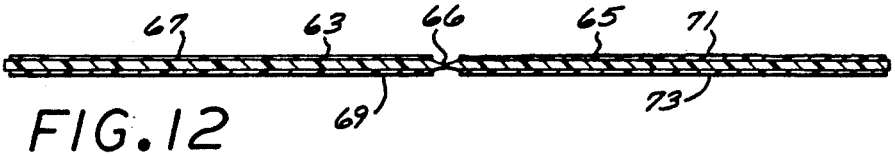
FIG. 12

POSEABLE DOLL MAGNETICALLY SECURED TO ITS STAND

BACKGROUND OF THE INVENTION

1. Field of the Invention

This invention relates to a doll stand for supporting a doll in an erect position.

2. Description of the Prior Art

The entertainment of value to a child of a lifelike doll has long been known. Modern day dolls typically exhibit a refined and fashionable appearance, frequently having a relatively slender, petite character. Such dolls often have the ankle and foot area formed in what is typically referred to as a fashion position with the toes extended thus leaving the bottom of the foot surface on an incline. Consequently, such dolls do not readily support themselves in an erect standing position. This shortcoming of present day dolls results in a diminishment of the entertainment value thereof since the child playing with such a doll must, in order to exhibit a lifelike erectness, manually hold or prop such doll in an erect position. Thus, there exists a need for a doll mechanism which incorporates a component mechanism for readily maintaining the doll in an erect position.

Many efforts have been made to solve this longstanding problem. One such effort is disclosed in U.S. Pat. No. 3,009,284 to Ryan. This patent discloses a doll formed in the ankle and foot area with a fashion position, the foot and ankle area then being formed with downwardly opening lined blind bores configured to telescopically receive a complemental stud projecting upwardly from a doll stand. Such an arrangement requires that the doll be configured with such bores resulting in wear between the studs and bores and careful manipulation of the legs for telescoping over such studs. Furthermore, such studs are susceptible to bending and breaking off under frequent use, thus discouraging commercial manufacture thereof.

Other types of doll supports have generally provided for a stand incorporating cavities which closely fit the contour of the doll's foot or are formed with retention straps for receiving the toe area of the foot in effort to maintain the doll in an erect position. Typical of such supports are the stands disclosed in U.S. Pat. No. 2,454,095 to Sandlovich and U.S. Pat. No. 3,345,030 to Speers. Such stand apparatus suffer the shortcoming that the strap portions of the stand provide a somewhat unsightly appearance detracting from the stylish doll design. Moreover, the limited applications thereof is indicated by the suggestion in the Sandlovich patent of an alternative support incorporating upstanding screw points intended for receipt in complemental threaded bores in the foot bottom. This arrangement, while effective to hold the doll erect, involves some degree of dexterity to utilize and leaves the sharp end of the screws dangerously exposed when not in use.

Other efforts have led to the proposal that the ankle or calf area of the doll be supported in retention clamps or sockets. Devices of this type are shown in U.S. Pat. No. 3,699,712 to Handler and U.S. Pat. No. 4,127,251 to Sapkus. Such devices, while being acceptable for their intended use of supporting the doll, being cumbersome, detract from the aesthetic appearance thereof since, in use, the holding bracket is readily visible as being clamped to doll's leg and, in many instances, actually obscure the doll's foot area or shoe from view.

Other efforts have led to a proposal that a doll stand be provided with an upstanding bracket for grasping the doll in the hip area to maintain it in an erect position. Again, a stand of this type affords an unsightly appearance, particularly for a doll clothed in attire such as bathing suits or shorts where the clamp would be fully exposed and would afford an unsightly appearance.

Thus, there exists a need for a doll stand which is practical to manufacture, easy for the child to use and which affords stability in the erectness of the doll while not detracting from the aesthetic appearance itself. Such a device should also accommodate different positions of the doll's foot relative to the leg.

SUMMARY OF THE INVENTION

The present invention is characterized by a ferromagnetic doll stand having a planar bottom for resting on a support surface and a planar top surface for receipt of a doll's foot device. The foot device may be in the form of magnetic inserts embedded directly in the doll's foot for being attracted to the base or may be in the form of removable shoes incorporating such magnetic inserts. In one embodiment the foot device incorporates a hinge element having latch positions for latching such element in selected different positions.

BRIEF DESCRIPTION OF THE DRAWINGS

FIG. 1 is a side view of a doll support apparatus embodying the present invention;

FIG. 2 is a partial rear view of the doll support apparatus shown in FIG. 1;

FIG. 3 is a vertical sectional view, in enlarged scale, taken along the line 3—3 of FIG. 2;

FIG. 4 is a perspective view, in enlarged scale, of a hinge incorporated in the doll support apparatus shown in FIG. 3;

FIGS. 5 and 6 are detail sectional views, in enlarged scale, taken along the line 5—5 in FIG. 4 but showing the hinge in selected different positions;

FIG. 7 is a vertical sectional view similar to FIG. 3 but showing the foot in a different position;

FIG. 8 is a vertical sectional view of a foot device incorporated in a second embodiment of the present invention;

FIG. 9 is a vertical sectional view similar to FIG. 8 but depicting the foot device in a different position;

FIG. 10 is a bottom view of the foot device shown in FIG. 9;

FIG. 11 is a perspective view, in reduced scale, of a base similar to that shown in FIG. 1;

FIG. 12 is a transverse sectional view, in enlarged scale, taken along the line 12—12 of FIG. 11; and FIGS. 13 and 14 are side views, in enlarged scale, of the base shown in FIG. 11 but depicting the base in respective folded positions.

DESCRIPTION OF THE PREFERRED EMBODIMENTS

The doll support apparatus of the present invention includes, generally, a doll 21 having a foot device 23 formed with a downwardly facing sole surface supported on a platform defining a ferromagnetic base 25. The foot device 23 includes ferromagnetic inserts 27 and 29 embedded in the foot and heel area, respectively, such that one or the other of such inserts may be supported on the base 25 in close proximity thereto for being attracted to such base to maintain the doll in an erect position.

Conventional dolls, such as those sold under the trademark "BARBIE DOLL" by Mattell, Inc., are constructed of malleable plastics, such that the ankle and foot areas of such dolls are relatively flexible, thus allowing the feet thereof to be flexed to different positions such as the positions shown in FIGS. 1 and 7. The position shown in FIG. 1 with the toes extended is typically referred to as a fashion position. The position shown in FIG. 7 with the foot flat on the base 25 may be thought of as a standing position.

The magnetic inserts 27 and 29 may be in the form of permanent magnetic elements having a cylindrical configuration to be received axially upwardly in complementary shaped cylindrical cavities formed in the bottom of the ball of the foot and heel area, respectively, and opening downwardly. The bottom surfaces of such inserts may, if desired, be covered with a thin layer of plastic to simulate the doll's skin.

In original doll construction, it is possible to embed a hinge, generally designated 31, in the ankle area of the foot device 23 for accommodating such flexure between the ankle 33 and foot 35.

The hinge 31 includes a pair of flanges 37 and 39 formed on their respective one ends with complemental, interfitting barrel sections 43 and 45 which receive a pivot pin 41. The barrel sections 43 and 45 are formed with axially projecting confronting latch elements 47 and 49 in the form of respective indentations and tangs which selectively engage one another to releasably lock the hinge in different selected positions, such as the position shown in FIG. 3 and the standing position shown in FIG. 7.

The base 25 may be formed of ferromagnetic material, such as steel, which might be painted on the top surface with a decorative finish or covered with a thin plastic coating to simulate, for instance, a beach or park scene.

In operation, the child playing with the doll of the present invention may place the base 25 on a support surface such as a floor with the decorative surface thereof facing upwardly. The doll's foot might then be rotated to the fashion position shown in FIG. 3 with the latching indentations and tangs 47 and 49 releasably latched in position to releasably hold the foot 35 in the fashion position. In this configuration, the sole of the forward section of the ball of the foot and toe area faces downwardly to position the bottom surface of the magnetic insert 27 flat against the top surface of the base 25 to thereby maintain close proximity between such insert and the base to afford a high degree of magnetic attraction therebetween. This serves to provide high attractive forces to maintain the doll securely in its erect position. It will be appreciated that, if desirable, only one foot may incorporate the aforementioned magnetic inserts 27 and 29. However, in the preferred embodiment, each foot incorporates such magnetic inserts, as well as the hinge 31.

In other applications, the child may desire to reorient the doll's legs, one with respect to the other, and/or to position the doll in a different pose, a pose which might be accommodated by rotating the foot 35 relative to the ankle 33 such that it assumes the flat position shown in FIG. 7. This may easily be achieved by merely grasping the toe area and rotating it in an upward direction to thus reposition the hinge flanges 37 and 39 from the position shown in FIG. 3 to the generally perpendicular position shown in FIG. 7. Again, the latch tang 49 and indentation 43 will interlock to maintain the foot releasably locked in such flat position. It will be appreciated by those skilled in the art that such flat orientation of the foot relative to the ankle will maintain the heel magnetic insert 29 with its bottom surface disposed flat against the base 25 to thereby provide for high magnetic attractive forces to thus maintain the doll securely in its erect position.

Referring to the embodiment shown in FIGS. 8–10, the foot device shown therein is in the form of a removable shoe, generally designated 51, which may be removably fitted to the doll's foot. The shoe 51 is formed with a flexible sole 53 having a forefoot area 57 positioned under the ball of the foot and the heel 59. Embedded in the forefoot area 57 is a magnetic insert 61 having its planar bottom surface disposed in parallel with the top surface of the base 25. Embedded in the heel 59 is a cylindrical magnetic element 63 having a flat bottom surface which may be selectively engaged against the top surface of the base 25 as shown in FIG. 9. Incorporated in the sole 53 is a hinge 31 to accommodate flexure between the fore sole 57 and heel 63 and to provide for selective and releasable locking in the positions shown in FIGS. 8 and 9.

In operation, the foot device 51 shown in FIGS. 8–10 may be strapped to the foot of a doll, similar to the doll shown in FIG. 1. However, with this configuration, it is not necessary that the doll's foot itself incorporate the inserts 27 and 29. Thus, such shoe may be utilized with a conventional doll to provide the advantages of this invention.

When so applied to the doll's foot, the shoe device 51 may be flexed to cause the hinge 31 to assume the orientation shown in FIG. 8 to thereby maintain the shoe in the fashion pose thus likewise maintaining the doll's foot and ankle orientation in a fashion pose. With the shoe so configured, and the doll placed on the base 25, the toe insert 61 will be maintained in close proximity to the base 25 to thereby maintain high magnetic attraction therebetween.

For other applications, it may be desirable for the child to flex the shoe sole 51 to the position shown in FIG. 9 to thus orient the doll's foot in a flatter position thereby disposing the toe insert 61 and heel insert 63 with the bottom surfaces thereof in the same plane such that both inserts will be simultaneously disposed in close proximity to the top surface of the base 25 to thereby maintain high magnetic attraction between such inserts and the base. In this configuration the high magnetic forces will provide an even greater stability to securely maintain the doll in its erect position.

Referring to FIGS. 11–14, a base, generally designated 61, which may be utilized in the present invention is in the form of a pair of plates 63 and 65. These plates are covered on their opposite sides with respective decorative coverings 67, 69, 71 and 73. The plates 63 and 65 are connected together along their proximal edge by means of a reduced in cross section hinge joint 66.

The various coverings 67–73 are constructed of a decorate finish to simulate, for instance, a sand beach 67, dance floor 69, grass 71 and tennis court 73. Consequently, by opening the base to various selected configurations as shown in FIGS. 13 and 14, the base will exhibit different simulated surfaces to thereby add to the enjoyment of playing with the doll 21 mounted on said base.

From the foregoing it will be apparent that the present invention is economical to manufacture and provides a straightforward solution to the problem typically associated with constructing a toy doll for support in an erect position from a base.

We claim:

1. Doll support apparatus comprising:

a ferromagnetic platform formed with an upwardly facing support surface;

a doll configured to stand in an erect position and including at least one leg including a foot device, including a foot portion having a heel section and forwardly projecting forefoot section, each section defining respective downward facing sole surfaces, said foot device including hinge means having sufficient flexibility to accommodate flexing of said foot portion between first and second positions, said foot device including magnetic inserts mounted in said forefoot and heel sections, respectively, and arranged to, when said hinge means is flexed to position said foot portion in said first position, dispose said forefoot magnetic insert in close proximity to said support surface to cooperate therewith to maintain said doll in an erect position and to, when said hinge mean is flexed to position said foot portion in said second position, dispose said heel magnetic insert in close proximity to said support surface to cooperate therewith to maintain said doll in an erect position.

2. Doll support apparatus as set forth in claim 1 wherein:

said foot device includes an ankle and said foot portion is in the form of a foot carried from said leg, said hinge means being disposed in said ankle and including releasable latching means for selectively and releasably latching said hinge means with said foot device disposed in said first and second positions.

3. Doll support apparatus as set forth in claim 1 wherein:

said foot device including an ankle and said foot portion includes a foot carried from said ankle, said device further including a shoe having a downwardly facing fore sole and reel sections and being removably received on said foot, said shoe being flexible to said first position with said fore sole contacting said upwardly facing surface and a second position with said heel contacting said upwardly facing surface, said forefoot and heel inserts being received in said fore sole and heel respectively for respective disposition in close proximity to said upwardly facing surface when said shoe is flexed to said respective first and second positions.

4. Doll support apparatus as set forth in claim 3 wherein:

said hinge means includes releasable latching means for selectively latching said shoe in said first and second positions.

5. Doll support apparatus comprising:

a ferromagnetic platform defining a base formed with a planar upwardly facing support surface;

a doll including a pair of legs and feet;

shoes removably received on said feet including first magnetic inserts embedded in respective first locations in the soles thereof and so configured and arranged as to, when said soles are engaged with said surface, maintain a magnetic force between said inserts and ferromagnetic base so as to maintain such doll in an erect position.

* * * * *